US012702887B2

(12) United States Patent
Rector et al.

(10) Patent No.: US 12,702,887 B2
(45) Date of Patent: Aug. 11, 2026

(54) NEUROSUIT SYSTEM

(71) Applicant: Neurosuit LLC, Villa Rica, GA (US)

(72) Inventors: Patricia Rector, Temple, GA (US); Sharon Gaiter, Winston, GA (US)

( * ) Notice: Subject to any disclaimer, the term of this patent is extended or adjusted under 35 U.S.C. 154(b) by 160 days.

(21) Appl. No.: 18/680,543

(22) Filed: May 31, 2024

(65) Prior Publication Data

US 2025/0367493 A1 Dec. 4, 2025

(51) Int. Cl.
*A63B 21/00* (2006.01)
*A63B 21/065* (2006.01)

(52) U.S. Cl.
CPC ..... *A63B 21/00185* (2013.01); *A63B 21/065* (2013.01); *A63B 21/4011* (2015.10); *A63B 21/4017* (2015.10); *A63B 21/4039* (2015.10); *A63B 2220/20* (2013.01); *A63B 2220/806* (2013.01)

(58) Field of Classification Search
CPC ..... A63B 21/00185; A63B 21/065
See application file for complete search history.

(56) References Cited

U.S. PATENT DOCUMENTS 7,153,246 B2 12/2006 Koscielny et al.
9,266,233 B2 * 2/2016 Kornbluh ..... A41D 13/002
9,591,993 B2 3/2017 Morris Bamberg et al.
11,020,261 B2 * 6/2021 Lear ..... A61F 5/0102
11,426,098 B2 8/2022 Rosato
2005/0255975 A1 * 11/2005 Horn ..... A63B 21/4011 482/124
2007/0004571 A1 * 1/2007 Gonzalez ..... A63B 21/4007 482/124
2018/0304134 A1 * 10/2018 Parque ..... A63B 21/4013
2019/0134454 A1 * 5/2019 Mahoney ..... A61B 5/0024
(Continued)

FOREIGN PATENT DOCUMENTS

CN 115814330 A * 3/2023 ..... A61H 3/00
CN 119185895 A * 12/2024 ..... A63B 24/0062
(Continued)

OTHER PUBLICATIONS

Brand:ADELI Medical Center; Title: "The effects of rehabilitation in the ADELI suit are many times higher!"; Dated: Feb. 8, 2024.
(Continued)

*Primary Examiner* — Zachary T Moore
(74) *Attorney, Agent, or Firm* — Jeremy A. Briggs

(57) ABSTRACT

A neurosuit system including a neurosuit, a sensory input device, and a suit control system is disclosed. The neurosuit may include a plurality of wearable pieces, and a plurality of bungee cords to interlock the plurality of wearable pieces. The sensory input device may be configured to capture a body movement of a user wearing the neurosuit. The suit control system may be communicatively coupled to the sensory input device and configured to receive inputs from the sensory input device, and determine the body movement based on the inputs. The suit control system may compare the body movement with an ideal body movement, and perform a predetermined action when the body movement is different from the ideal body movement. The predetermined action may be associated with the plurality of bungee cords.

16 Claims, 5 Drawing Sheets

(56) References Cited

U.S. PATENT DOCUMENTS

| | | | | |
|---|---|---|---|---|
| 2019/0374161 | A1* | 12/2019 | Ly | A61F 2/68 |
| 2020/0085123 | A1* | 3/2020 | Achtymichuk | A63B 21/0407 |
| 2021/0162263 | A1* | 6/2021 | Roh | A61H 1/024 |
| 2022/0264967 | A1* | 8/2022 | Bassoo | A63B 21/4007 |
| 2025/0152992 | A1* | 5/2025 | He | A63B 21/0603 |
| 2025/0195939 | A1* | 6/2025 | Wang | A63B 21/0054 |

FOREIGN PATENT DOCUMENTS

| | | | | |
|---|---|---|---|---|
| WO | WO-2015002850 | A1 * | 1/2015 | A63F 13/21 |
| WO | WO-2020115122 | A2 * | 6/2020 | A63B 21/4025 |

OTHER PUBLICATIONS

Brand: NAPA; Title:"NeuroSuit" dated: Mar. 19, 2024 Website Link: https://napacenter.org/therapy-tools/neurosuit/.

Herran et al; Title:Gait Analysis Methods: An Overview of Wearable and Non-Wearable Systems, Highlighting Clinical Applications; dated: Feb. 19, 2014.

Brand: FAU; Title: "AI supports rehabilitation after spinal cord injury"; dated: Jun. 29, 2023 Website: https://www.fau.eu/2023/06/29/news/research/ai-supports-rehabilitation-after-spinal-cord-injury/.

* cited by examiner

NEUROSUIT SYSTEM

FIELD

The present disclosure relates to a neurosuit system.

BACKGROUND

Neurosuit is a therapy used to treat development delays, cerebral palsy, ataxia, autism spectrum disorder, gait retraining after stroke, and/or the like. The principle of the neurosuit is to move body parts against a resistance, thereby improving muscle strength. The neurosuit includes elastic bands or bungee cords to correctly align the body, improve coordination between body parts during body movement, and normalize gait pattern.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
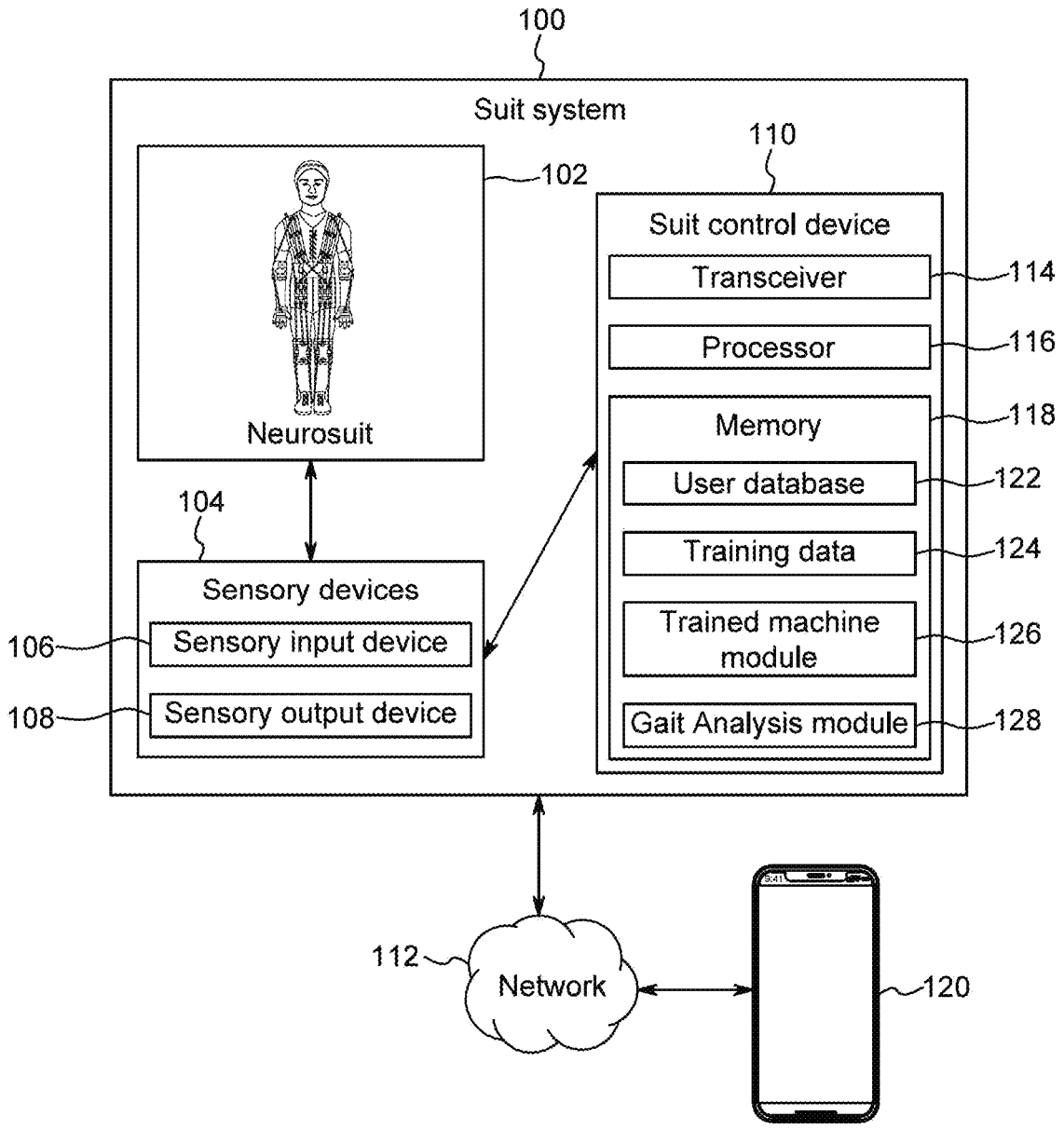
FIG. 1 depicts a block diagram of an example suit system in accordance with the present disclosure.

The present disclosure describes a neurosuit system to facilitate correct alignment of a user's body, improve coordination between different body parts during body movement, and normalize a user's gait pattern. The neurosuit system may include a neurosuit, one or more sensory devices, and a suit control device. The neurosuit may include a plurality of wearable pieces such as a vest, shorts, knee pads, elbow pads, gloves, shoe attachments, a hat, and/or the like. The neurosuit may further include a plurality of bungee cords that may be attached to the wearable pieces to interlock the wearable pieces. The plurality of bungee cords may be elastic bands that may provide compression to joints, and distribute a vertical weight bearing to the user's entire body.

In some aspects, the sensory devices may include a sensory input device and a sensory output device, which are communicatively coupled to the suit control device. The sensory input device may include one or more Inertial Measurement Unit (IMU) sensors and/or one or more cameras, which may be configured to capture body movement of a user wearing the neurosuit. In some aspects, the IMU sensor may be attached to the neurosuit. The sensory output device may include a vibrator that may be movably attached to the neurosuit (e.g., on the bungee cord), which may be actuated by the suit control device. Alternatively, the vibrator may not be attached to the neurosuit, and may instead be wrapped around a user's body part.

The suit control device may be configured to obtain inputs from the sensory input device, and determine the user's body movement based on the obtained inputs. For example, the suit control device may perform gait analysis based on the inputs, and determine the user's body movement based on the gait analysis. The suit control device may further obtain ideal/desired body movement (or information associated with the ideal body movement) of the user from a memory, and compare the body movement and the ideal body movement. Based on the comparison of the body movement and the ideal body movement, the suit control device may perform a predetermined action. Specifically, the suit control device may perform the predetermined action when the body movement may be different from the ideal body movement. In some aspects, the predetermined action may include generating a recommendation and outputting the recommendation on a user interface. In further aspects, the predetermined action may include actuating the vibrator to provide haptic feedback to the user.

In some aspects, the suit control device may be further configured to determine/identify a deficit or difference between the body movement and the ideal body movement. Responsive to determining the deficit, the suit control device may determine a muscle group associated with the deficit, and determine a bungee cord associated with the muscle group. Responsive to determining/identifying the bungee cord, the suit control device may determine an optimal position of the bungee cord, and determine the bungee cord's existing position. The suit control device may then compare the optimal position and the existing position, and perform the predetermined action when the optimal position may be different from the existing position. In some aspects, the predetermined action may include generating the recommendation to manage/adjust the bungee cord(s), and outputting the recommendation on the user interface. For example, the suit control device may regenerate a recommendation to move the bungee cord from the existing position to the optimal position to provide more compression force to the muscle group, and/or to add (or remove) another bungee cord in proximity to the muscle group. In further aspects, the neurosuit may include infrared light sources configured to provide infrared therapy to the user, which may be actuated by the suit control device based on operator inputs.

The present disclosure discloses a neurosuit system that provides recommendation to the operator of the neurosuit to adjust the bungee cord at the optimal position (via machine learning), thereby providing effective therapy to the user. In addition, the use of vibrator enables the neurosuit system to provide a real-time feedback to the user to correct user's body movement. In addition, the use of IMU/camera enables the neurosuit system to effectively perform gait analysis and determine a deficit in the user's body movement and an ideal body movement.

These and other advantages of the present disclosure are provided in detail herein.

ILLUSTRATIVE EMBODIMENTS

The disclosure will be described more fully hereinafter with reference to the accompanying drawings, in which example embodiments of the disclosure are shown, and not intended to be limiting.

Figure 2:
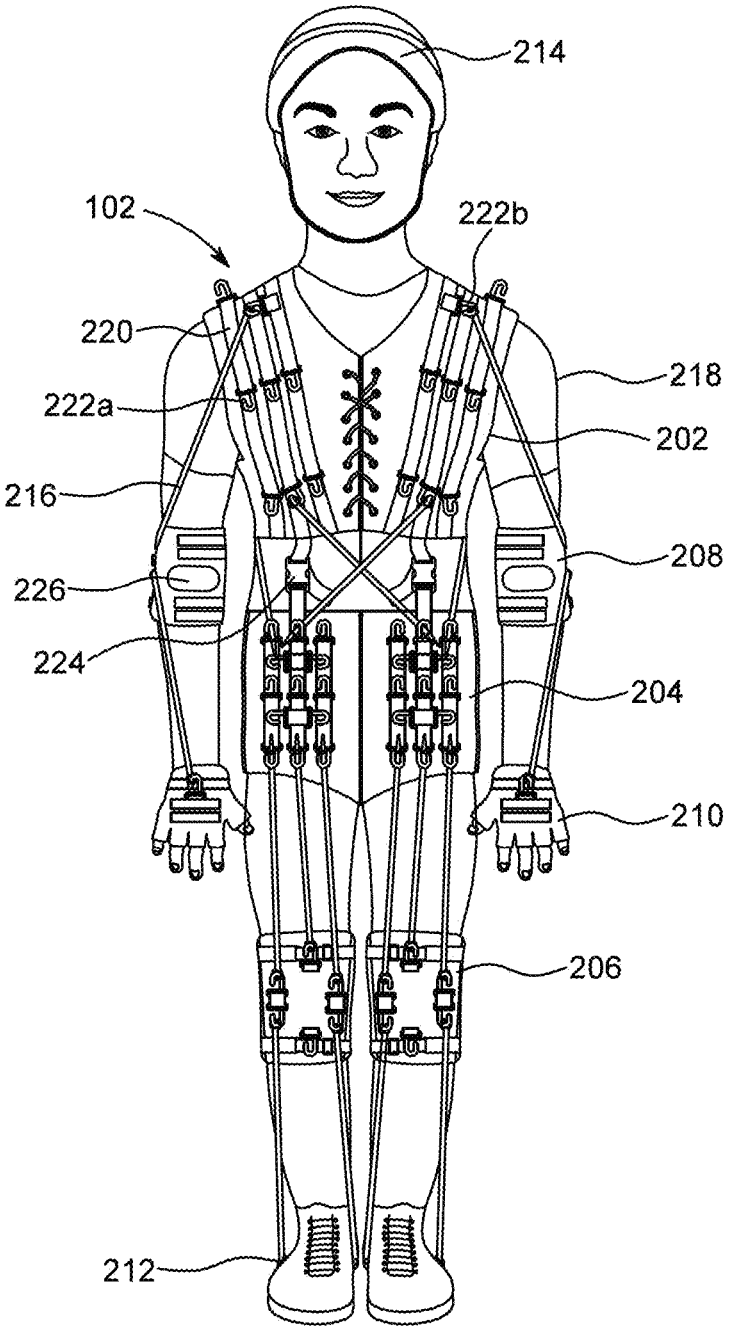
FIG. 2 depicts an example front view of a neurosuit in accordance with the present disclosure.

FIG. 1 depicts a block diagram of an example suit system 100 in accordance with the present disclosure. FIG. 1 will be described in conjunction with FIGS. 2-4. FIG. 2 depicts an example front view of a neurosuit, FIG. 3 depicts an example back view of a neurosuit, and FIG. 4 depicts a snapshot of an example recommendation in accordance with the present disclosure.

Figure 3:
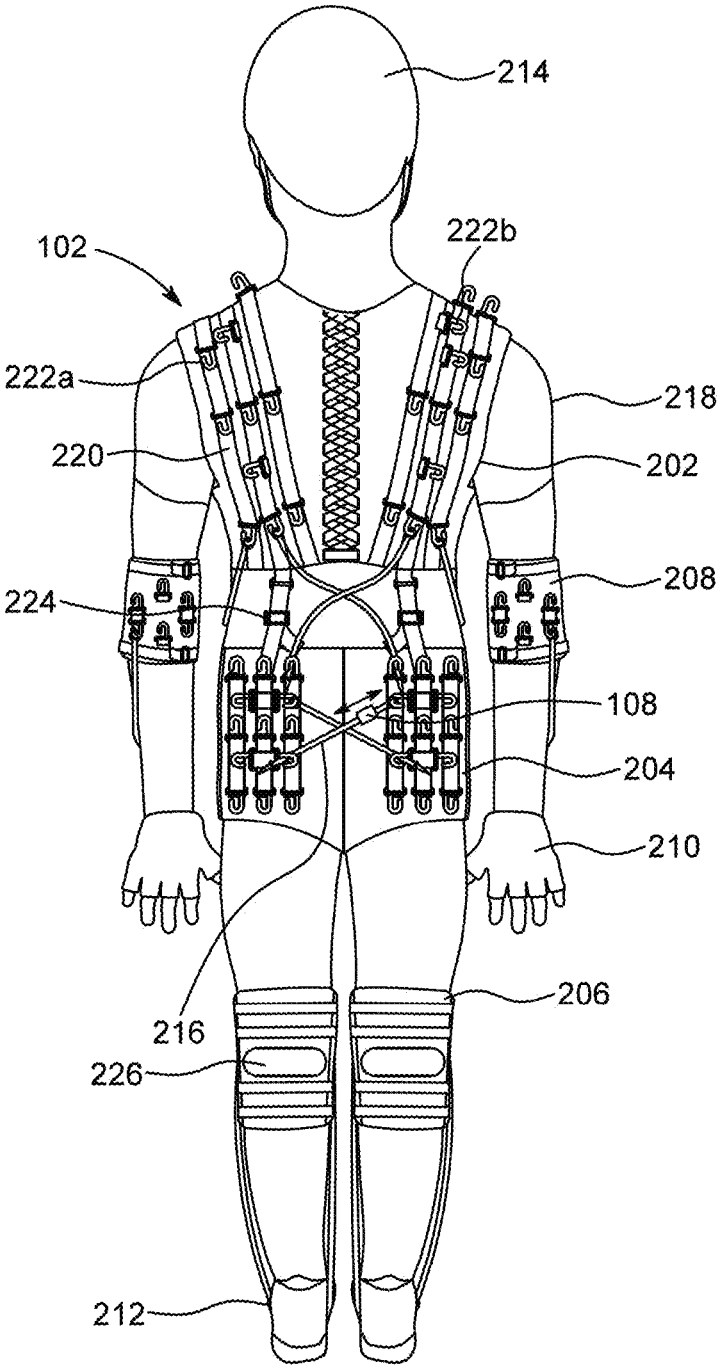
FIG. 3 depicts an example back view of a neurosuit in accordance with the present disclosure.
Figure 4:
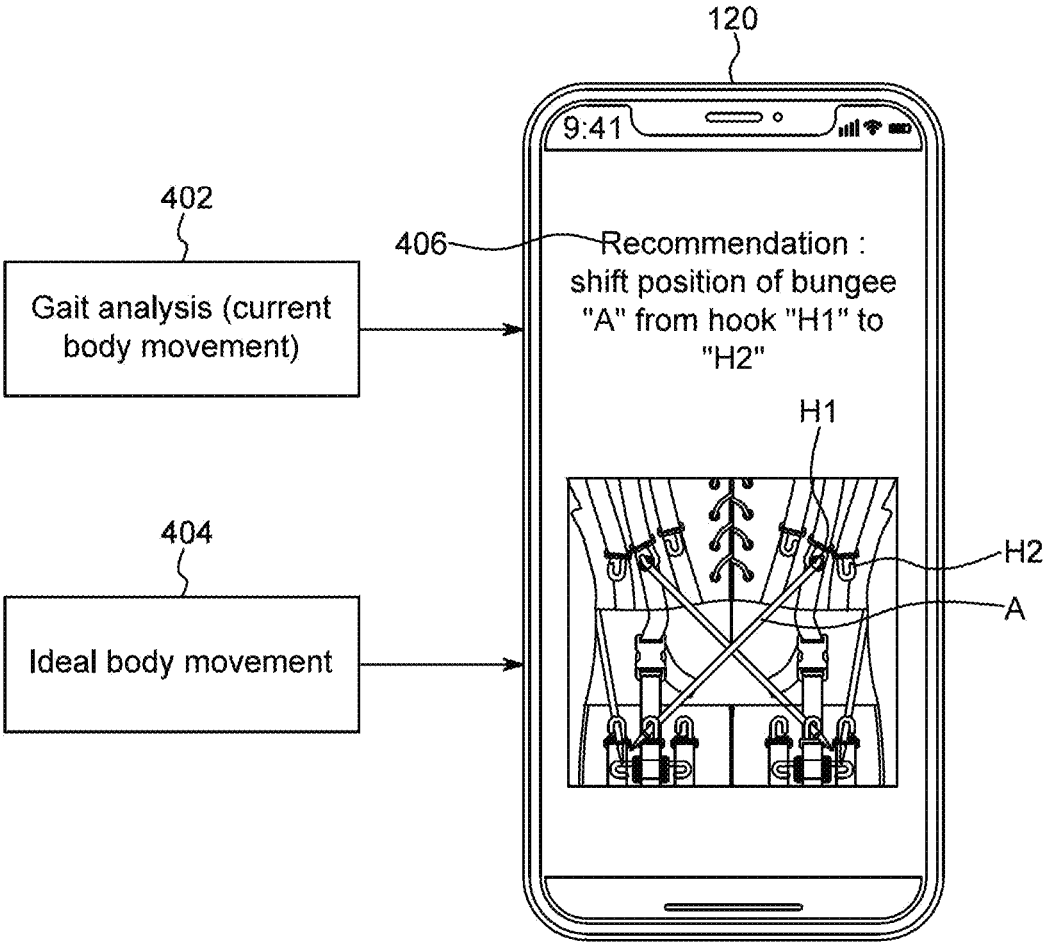
FIG. 4 depicts a snapshot of an example recommendation in accordance with the present disclosure.

The suit system 100 may include a neurosuit 102 that may include a plurality of wearable pieces including, but not limited to, a vest 202, shorts 204, knee pads 206, elbow pads 208, gloves 210, shoe attachments 212, and a hat 214 (as shown in FIGS. 2 and 3). In some aspects, the plurality of wearable pieces may be of any dimensions, based on physical dimensions of a user 218 who may be wearing the neurosuit 102. In addition, the wearable pieces may be made of any material. For example, the wearable pieces may be made of any breathable fabric. The neurosuit 102 may further include a plurality of bungee cords 216 that may be configured to interlock the plurality of wearable pieces. The bungee cords 216 may be elastic bands that may provide compression to joints, and distribute a vertical weight bearing to the user's entire body. The bungee cords 216 may facilitate in re-training the brain and strengthening the muscle through the resistance of the bungee cords 216. The user 218 may wear the neurosuit 102 over the user's clothes, which may facilitate correct alignment of the user's body, improve coordination between body parts during body movement, and normalize gait pattern.

In some aspects, the vest 202 may include a plurality of vertical straps 220 that may be disposed at a vest front portion and a vest back portion (as shown in FIGS. 2 and 3). In an exemplary aspect, the vertical straps 220 may include a first strap, a second strap, and a third strap, which may be positioned adjacent to each other (e.g., parallel to each other). In other aspects, there may be more or less than three vertical straps in the vest 202. In some aspects, each vertical strap may include a plurality of hooks 222*a*, 222*b* (collectively referred as hooks 222) that may be sewn (i.e., non-removably connected) to the vertical straps 220. The hooks 222 may be made of any dimensions, and may be made of any material. In an exemplary aspect, the hooks 222 may be made of plastic.

The hooks 222 may be configured to engage with the bungee cords 216 to enable the bungee cords 216 to interlock with the vest 202. The hooks 222 may be connected pivotally on the vertical straps 220. In some aspects, the hooks 222 may be disposed at different heights (and/or in any pattern) on the vertical straps 220 to enable the bungee cords 216 to provide desired compression to the joints. In some aspects, the shorts 204 may include similar vertical straps and hooks, which may be disposed in the same manner as described above and which enable interlocking of the shorts 204 with the bungee cords 216. In addition, the other pieces of the wearable pieces may also include hooks and straps to enable the bungee cords 216 to interlock/connect with the wearable pieces. The hooks may be disposed in any pattern on different wearable pieces.

In further aspects, the hooks 222 may include a vertical set of hooks (including the hook 222*a*) and a horizontal set of hooks (including the hook 222*b*). In some aspects, the vertical set of hooks may be oriented/positioned perpendicular to the horizontal set of hooks. In some aspects, the vertical set of hooks may be used to facilitate vertical connections including, but not limited to, connection between the vest 202 and the shorts 204, the knee pads 206, the shoe attachments 212, the elbow pads 208 and the gloves 210, etc. In further aspects, the horizontal set of hooks may be used to facilitate horizontal connections including, but not limited to, connection between a front portion of the shorts 204 to a back portion of the shorts 204 (e.g., to support hips) and connection between arm and elbow region, thereby reducing forces on the hooks and preventing discomfort to the user 218.

In some aspects, the vest 202 and the shorts 204 may be connected by one or more fasteners 224. In an exemplary aspect, the fastener 224 may be a buckle connector 224 that may removably connect the vest 202 with the shorts 204, to facilitate easy/quick attachment/detachment of the vest 202 with the shorts 204. In some aspects, the buckle connector 224 may be configured to connect the vest front portion with the shorts front portion. In further aspects, the buckle connector 224 may be configured to connect the vest back portion with the shorts back portion. In some aspects, the buckle connector 224 may include a male connection member and a female connection member, which may be configured to engage with each other to attach/detach the vest 202 with the shorts 204. The buckle connector 224 may be of any dimensions, and may be made of any material. In an exemplary aspect, the buckle connector 224 may be made of plastic.

In some aspects, each of the knee pads 206 and the elbow pads 208 may include an opening 226 to allow easy movement of user's elbows and knees. In an exemplary aspect, the opening 226 may be located at a center portion of the knee pads 206 and the elbow pads 208. Further, the opening 226 may be located at a front portion of the elbow pads 208, and at a back portion of the knee pads 206. In some aspects, the opening 226 may be covered by a fabric, so that the user 218 may feel comfortable when the user 218 may be moving wearing the neurosuit 102.

The suit system 100 may further include one or more sensory devices 104. The sensory devices 104 may include a sensory input device 106 and a sensory output device 108. The sensory input device 106 may be configured to capture body movements of the user 218 (e.g., when the user 218 may be wearing the neurosuit 102). The sensory output device 108 may be configured to provide feedback to the user 218. In some aspects, the sensory output device 108 may include a vibrator (hereinafter referred to as vibrator 108) that may be configured to output haptic feedback or vibrate based on command signals received by the vibrator 108. The vibrator 108 may be attached at a plurality of different locations on the neurosuit 102. In an exemplary aspect, the vibrator 108 may be attached to one or more bungee cords 216. Alternatively, the vibrator 108 may not be attached to the neurosuit 102, and may instead be wrapped around a user's body part. In some aspects, the vibrator 108 may be movably attached to the bungee cords 216. For example, the vibrator 108 may be configured to slide on the bungee cords 216 between the bungee cord's opposite ends, as shown in FIG. 3. The suit system 100 may further include a suit control device 110 that may be communicatively coupled to the sensory devices 104.

In one exemplary aspect, the sensory input device 106 may be a wearable device that may be attached to one or more wearable pieces and/or one or more bungee cords 216. In an exemplary embodiment, the sensory input device 106 may include a plurality of Inertial Measurement Unit (IMU) sensors that may be attached to different parts/locations of the neurosuit 102 (e.g., the wearable pieces and/or the bungee cords 216). The IMU sensor may include a combination of an accelerometer, a gyroscope, and/or a magnetometer. The IMU sensor may be configured to capture body motion or user's body movements over a predefined time duration when the user 218 wears the neurosuit 102. In further aspects, the IMU sensor may be configured to detect/measure user's gait characteristics. For example, the IMU sensor may detect the user's knee joint angle, elbow joint angle, ankle joint angle, and/or the like, when the user 218 wears the neurosuit 102. Each IMU sensor may be configured to transmit information/signals associated with the captured user's body movements and/or measurement to the suit control device 110 at a predefined frequency. The IMU sensor may be configured to transmit the above-mentioned data to the suit control device 110 directly via a wired connection or wirelessly via a network 112.

The network 112 illustrates an example communication infrastructure in which the connected devices discussed in various embodiments of this disclosure may communicate. The wireless network may be and/or include the Internet, a private network, public network or other configuration that operates using any one or more known communication protocols such as transmission control protocol/Internet protocol (TCP/IP), Bluetooth®, Bluetooth® Low Energy (BLE), Wi-Fi based on the Institute of Electrical and Electronics Engineers (IEEE) standard 802.11, ultra-wideband (UWB), and cellular technologies such as Time Division Multiple Access (TDMA), Code Division Multiple Access (CDMA), High-Speed Packet Access (HSPDA), Long-Term Evolution (LTE), Global System for Mobile Communications (GSM), and Fifth Generation (5G), to name a few examples.

In another exemplary embodiment, the sensory input device 106 may include a non-wearable device that may not be attached to the neurosuit 102. In this exemplary embodiment, the sensory input device 106 may be a camera (e.g., an RGB camera) that may be configured to capture body motion or user's body movements over the predefined time duration when the user 218 wears the neurosuit 102. For example, the camera may capture user's images (to capture user's body movements) when the user 218 may be wearing the neurosuit 102 and walking/moving. In some aspects, the camera may be installed in a space/environment in which the user 218 (with the neurosuit 102) may be walking/moving. The camera may be configured to capture the user's images at a predefined frequency, and may transmit the captured images to the suit control device 110 via a wired connection or wirelessly via the network 112.

The suit control device 110 may include a plurality of components/units including, but not limited to, a transceiver 114, a processor 116, and a memory 118, which may be communicatively coupled with each other. In some aspects, the suit control device 110 may be a part of the neurosuit 102 (i.e., attached to the neurosuit 102). In other aspects, the suit control device 110 may not be part of the neurosuit 102, and may be located in a remote server (not shown). In some aspects, the suit control device 110 may be configured to obtain inputs from the sensory input device 106, via the network 112. In addition, the suit control device 110 may be configured to output control signals/feedback to the sensory output device 108, as described later below in the description.

The transceiver 114 may be configured to transmit/receive information/data to/from external systems and the sensory devices 104 (including the sensory input device 106 and the sensory output device 108). In some aspects, the external system may include a user device 120 associated with an operator/guardian associated with the user 218, which may be communicatively coupled to the suit control device 110 via the network 112. The user device 120 may include, but is not limited to, a mobile, a tablet, a laptop, a smartwatch, or any device having communication capability.

The processor 116 may be in communication with one or more memory devices in communication with the respective computing systems (e.g., the memory 118 and/or one or more external databases not shown in FIG. 1). The processor 116 may utilize the memory 118 to store programs in code and/or to store data for performing aspects in accordance with the disclosure. The memory 118 may be a non-transitory computer-readable storage medium or memory storing a program code that enables the processor 116 to perform operations in accordance with the present disclosure. The memory 118 may include any one or a combination of volatile memory elements (e.g., dynamic random-access memory (DRAM), synchronous dynamic random-access memory (SDRAM), etc.) and may include any one or more nonvolatile memory elements (e.g., erasable programmable read-only memory (EPROM), flash memory, electronically erasable programmable read-only memory (EEPROM), programmable read-only memory (PROM), etc.).

The memory 118 may include a plurality of databases and modules including, but not limited to, a user database 122, training data 124 (or training dataset), a trained machine module 126, a gait analysis module 128, and/or the like. The user database 122 may include information associated with the user 218 including, but not limited to, a user age, user body characteristics, user medical history, user images, desired body movement (as desired by the operator associated with the user 218), information associated with user's historical body movements, and/or the like. The training data 124 may include correlation of ideal body movements and information associated with a plurality of users. An ideal body movement may be a desired body movement for a user (as desired by operator). The trained machine module 126 and the gait analysis module 128, as described herein, may be stored in the form of computer-executable instructions, and the processor 116 may be configured and/or programmed to execute the stored computer-executable instructions for performing functions/operation in accordance with the present disclosure. In some aspects, the trained machine module 126 may be configured to determine the ideal body movement for the user 218, as described below. The gait analysis module 128 may be configured to determine the body movement associated with the user 218 based on the inputs obtained from the sensory input device 106.

In some aspects, the processor 116 may use machine learning to perform operations described in the present disclosure. Machine learning is an application of artificial intelligence (AI) wherein systems may have the ability to automatically learn and improve from experience without being explicitly programmed. The machine learning focuses on use of data and algorithm to imitate the way humans learn. Specifically, the machine learning algorithms are created to make classifications or predictions.

The machine learning may be of various types based on data or signals available to learning system. In some aspects, the machine learning approach may include supervised learning, unsupervised learning, semi-supervised learning, or reinforcement learning. The supervised learning is an approach that is supervised by a human. In this approach, the machine learning algorithm involves labeled training data and defined variables to assess for correlations. In this, both the input and the output of the algorithm is specified, and the algorithms may be trained to classify data or predict outcomes accurately.

Broadly, the supervised learning may be of two types "regression" and "classification". In classification learning, the algorithm helps in dividing the dataset into classes based on different parameters. In this, a computer program is trained on the training dataset and based on that training, it categorizes the data into different classes. Some methods used in classification learning include Logistic Regression, K-Nearest Neighbors, Support Vector Machines (SVM), Kernel SVM, Naïve Bayes, Decision Tree Classification, and Random Forest Classification. In regression learning, the algorithms help in finding the correlations between dependent and independent variables. In Regression, the output variable must be of continuous nature or real value. Some methods used in classification learning include Simple Linear Regression, Multiple Linear Regression, Polynomial Regression, Support Vector Regression, Decision Tree Regression, Random Forest Regression, etc.

The unsupervised learning is an approach that involves an algorithm that trains on unlabeled data. The algorithm analyzes the data by its own and find patterns in the data. The semi-supervised learning is a combination of the supervised learning and the unsupervised learning. The algorithm involves labeled training data but the model is free to find pattern in the data. The reinforcement learning is a multi-step or dynamic process. This model is similar to supervised learning, but is not trained using sample data. This model learns as it goes by using trial and error. A sequence of successful outcomes will be reinforced to develop the best recommendation or policy for a given problem.

In an exemplary aspect, the suit control device 110 uses supervised machine learning algorithms/module to perform operations described below in the present disclosure. The supervised machine learning module may be trained by using the training data 124 (as labeled data) to generate the trained machine module 126. Specifically, the supervised machine learning module may generate the trained machine module 126 to determine the ideal body movement for the user 218. In some aspects, the trained machine module 126 may obtain information from the user database 122 and use the training data 124 to determine the ideal body movement for the user 218. For example, the trained machine module 126 may obtain user age/body characteristics associated with the user 218 from the user database 122, and use the training data 124 to determine the ideal body movement for the user 218 based on the user's age/body characteristics. In further aspects, the trained machine module 126 may store the information associated with the determined ideal body movement in the user database 122 or anywhere else in the memory 118.

In operation, the processor 116 may obtain inputs from the sensory input device 106 (e.g., the IMU and/or the camera), via the transceiver 114. Responsive to obtaining the inputs, the processor 116 may determine the body movement of the user 218 (e.g., by executing the instructions stored in the gait analysis module 128), based on the inputs obtained from the sensory input device 106. Specifically, the processor 116 may analyze the user's gait pattern or how the user 218 may be moving (or "current body movement") when the user 218 may be wearing the neurosuit 102, based on the inputs obtained from the sensory input device 106 (as indicated in block 402 of FIG. 4).

In one exemplary embodiment, the processor 116 may obtain inputs (e.g., measurements) from the plurality of IMUs (attached to the neurosuit 102), and correlate the measurements obtained from the plurality of IMUs. The processor 116 may determine the user's body movement based on the correlation. For example, the processor 116 may determine how each body part may be moving relative to other body parts based on the correlation, and accordingly determine the user's overall body movement.

In another exemplary embodiment, the processor 116 may obtain inputs/user's images or videos from the camera (that may not be attached to the neurosuit 102), via the network 112, and may determine the body movement based on the inputs obtained from the camera. Specifically, the processor 116 may obtain a video having a plurality of frames from the camera, and analyze the plurality of frames to determine the user's body movement. In some aspects, the processor 116 may perform frame-by-frame analysis, and analyze the user's gait pattern or how the user 218 may be moving when the user 218 may be wearing the neurosuit 102, based on the frame-by-frame analysis.

Responsive to determining the user's body movement based on the inputs obtained from the sensory input device 106, the processor 116 may obtain information associated with the ideal body movement from the user database 122 (as shown in block 404 of FIG. 4), which may be determined by the trained machine module 126, as described above. In other aspects, the information associated with the ideal body movement may be pre-stored by the operator (associated with the user device 120) associated with the neurosuit 102 in the memory 118 (e.g., the user database 122). Responsive to obtaining the ideal body movement information, the processor 116 may compare the determined body movement with the ideal body movement (by using the information associated with the ideal body movement). Based on the comparison of the body movement and the ideal body movement, the processor 116 may perform a predetermined action. Specifically, the processor 116 may perform the predetermined action when the body movement may be different from the ideal body movement. In some aspects, the predetermined action may include generating a recommendation for the operator and outputting the recommendation on a user interface associated with the user device 120 (as shown in snapshot 406 of FIG. 4). In further aspects, the predetermined action may include actuating/controlling the sensory output device 108. The aspect of the predetermined action may be understood as follows.

In some aspects, the processor 116 may identify a deficit in the body movement and the ideal movement based on the comparison of the body movement and the ideal body movement. Stated another way, the processor 116 may identify a difference between the user's current body motion/movement and the desired/ideal body motion or movement for the user 218. For example, the processor 116 may determine whether the user 218 may be leaning towards right while walking with the neurosuit 102, as opposed to walking straight.

Responsive to identifying the deficit or determining that the user's determined body movement may be different from the ideal body movement, the processor 116 may identify/determine a muscle group associated with the deficit. For example, the processor 116 may determine that the deficit may be associated with user's chest, back, arms, legs, shoulders, and/or the like. In some aspects, the processor 116 may determine the muscle group based on a mapping of a plurality of muscle groups and deficits that may be pre-stored in the memory 118. In some aspects, the processor 116 may use another trained machine module (trained on another dataset) to determine the muscle group. In such cases, the training data may include a correlation of a plurality of deficits with muscle groups.

Responsive to determining the muscle group, the processor 116 may determine one or more bungee cords, from the plurality of bungee cords 216, which may be associated with the muscle group. For example, the processor 116 may determine that the bungee cord associated with the identified muscle group may be bungee cord "A", as shown in FIG. 4.

Responsive to identifying the bungee cord "A", the processor 116 may determine an optimal position of the bungee cord "A". In some aspects, the processor 116 may determine the optimal position based on the muscle group and/or the deficit. In some aspects, the processor 116 may determine required compression on the muscle group, and determine the optimal position based on the required compression. The processor 116 may determine the optimal position such that the neurosuit 102 may facilitate the user 218 to move/walk according to the ideal body movement.

The processor 116 may further determine the existing or a current position of the bungee cord "A" in the neurosuit 102 that the user 218 may be wearing. In some aspects, the processor 116 may determine the existing position of the bungee cord "A" based on the images/videos obtained from the camera. In other aspects, the processor 116 may determine the bungee cord's existing position via operator inputs. Responsive to determining the bungee cord's existing position, the processor 116 may compare the existing position with the optimal position. The processor 116 may then perform the predetermined action when the existing position may be different from the optimal position. Stated another way, the processor 116 may perform the predetermined action based on the comparison of the existing position with the optimal position. The predetermined action may be associated with the one or more bungee cords 216.

In some aspects, the predetermined action may include generation of a recommendation when the existing position may be different from the optimal position, and outputting of the recommendation to a user interface associated the user device 120 (as shown in snapshot 406 of FIG. 4), via the transceiver 114. Stated another way, the processor 116 may determine a better way to attach the bungee cord "A", and output the determined "better way" to the user interface, so that the operator may correct the bungee cord "A" position. In some aspects, the processor 116 may generate the recommendation based on the comparison between the existing position and the optimal position.

In some aspects, the recommendation may include recommending a change of the bungee cord "A" position from the existing position to the optimal position (e.g., to increase/decrease the compression associated with the bungee cord "A"). As described above, the processor 116 may recommend the change of position when the optimal position may be different from the existing position. For example, as shown in the snapshot 406, the processor 116 may generate the recommendation to shift the bungee cord "A" position from a hook "H1" (e.g., the existing position) to a hook "H2" (e.g., the optimal position). The operator may view the recommendation on the user interface, and may adjust the bungee cord "A" position accordingly. In addition, the recommendation may include attaching/adding another bungee cord at the optimal position or removing the bungee cord "A" from the existing position, to facilitate the user 218 to move according to the ideal body movement.

In further aspects, the predetermined action may include controlling or actuating the sensory output device 108 that may be disposed on the identified bungee cord "A". As described above, the sensory output device 108 may include the vibrator 108 that may be configured to provide feedback to the user 218. The processor 116 may actuate/trigger the vibrator 108 that may be disposed on the identified bungee cord "A" to provide haptic feedback to the user 218, indicating that the user 218 needs to correct motion of the muscle group associated with the bungee cord "A".

In this case, responsive to determining that the bungee cord "A" may be associated with the affected muscle group or the muscle group that may be causing improper body movement, the processor 116 may identify the vibrator 108 that may be disposed on the bungee cord "A". The processor 116 may then transmit a control signal to the vibrator 108 to actuate the vibrator 108, and cause the vibrator 108 to vibrate at a predefined frequency (or in a predefined pattern) to provide feedback to the user 218 or to re-train user's brain to use the muscle group associated with the deficit (or re-train user's motor responses). In some aspects, the processor 116 may update the predefined frequency based on operator's inputs or based on the deficit.

In alternative aspects, the processor 116 may actuate the sensory output device 108 even when the existing position may be same as the optimal position. Stated another way, the processor 116 may actuate the sensory output device 108 when the identified bungee cord is correctly positioned at the optimal position. In this case, the processor 116 may actuate the sensory output device 108 when the user's current body movement may be different from the ideal body movement (irrespective of the bungee cord position).

Figure 5:
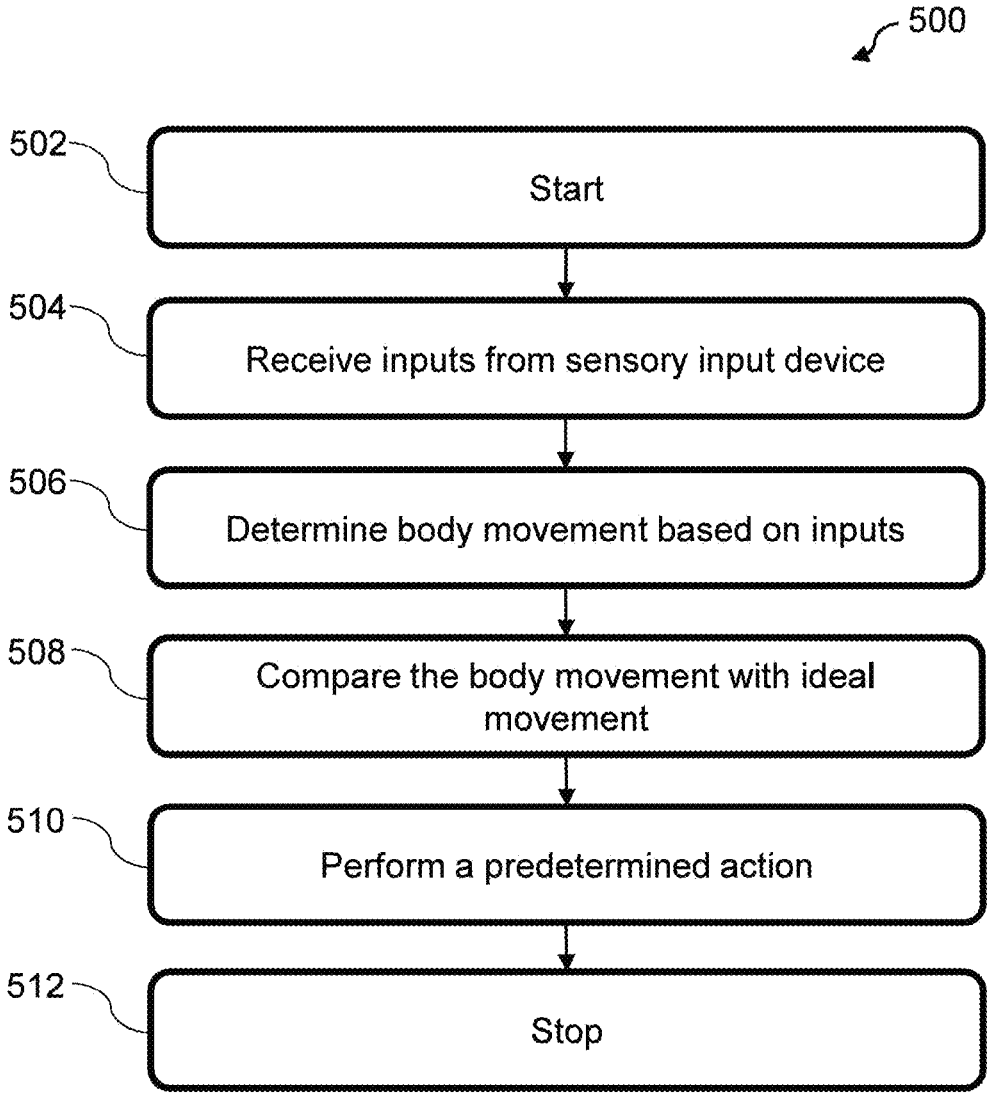
FIG. 5 depicts a flow diagram of an example suit control method in accordance with the present disclosure.

FIG. 5 depicts a flow diagram of an example suit control method 500 in accordance with the present disclosure. FIG. 5 may be described with continued reference to prior figures. The following process is exemplary and not confined to the steps described hereafter. Moreover, alternative embodiments may include more or less steps than are shown or described herein and may include these steps in a different order than the order described in the following example embodiments.

The method 500 starts at step 502. At step 504, the method 500 may include receiving, by the processor 116, inputs from the sensory input device 106 (IMU and/or camera). At step 506, the method 500 may include determining, by the processor 116, user's body movement based on the inputs. For example, the processor 116 may analyze the user's gait pattern or how the user 218 may be walking/moving. At step 508, the method 500 may include comparing, by the processor 116, the user's body movement with the ideal body movement (e.g., by using the information associated with the ideal body movement stored in the user database 122, which may be determined by using the trained machine module 126). At step 510, the method 500 may include performing, by the processor 116, the predetermined action when the body movement ay be different from the ideal body movement. The predetermined action may be associated with the plurality of bungee cords. For example, the predetermined action may include generating the recommendation and/or actuating the vibrator 108, as described above.

At the step 512, the method 500 may stop.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

Further, where appropriate, the functions described herein can be performed in one or more of hardware, software, firmware, digital components, or analog components. For example, one or more application specific integrated circuits (ASICs) can be programmed to carry out one or more of the systems and procedures described herein. Certain terms are used throughout the description and claims refer to particular system components. As one skilled in the art will appreciate, components may be referred to by different names. This document does not intend to distinguish between components that differ in name, but not function.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Computing devices may include computer-executable instructions, where the instructions may be executable by one or more computing devices such as those listed above and stored on a computer-readable medium.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A neurosuit system comprising:

a neurosuit comprising:

a plurality of wearable pieces; and a plurality of bungee cords to interlock the plurality of wearable pieces;

a sensory input device configured to capture a body movement of a user wearing the neurosuit;

a suit control device communicatively coupled to the sensory input device, wherein the suit control device is configured to:

receive inputs from the sensory input device;

determine the body movement based on the inputs;

compare the body movement with an ideal body movement;

identify a deficit in the body movement and the ideal body movement based on the comparison;

determine a muscle group associated with the deficit;

determine a bungee cord, of the plurality of bungee cords, associated with the muscle group; and, determine an optimal position of the bungee cord based on the deficit and the muscle group;

determine an existing position of the bungee cord;

compare the existing position with the optimal position; and perform a predetermined action when the when the existing position is different from the optimal position, wherein the predetermined action is associated with the plurality of bungee cords, and wherein, to perform the predetermined action, the suit control device:

generates a recommendation to change a position of the bungee cord from the existing position to the optimal position; and outputs the recommendation to a user interface.

2. The neurosuit system of claim 1, wherein the sensory input device is a camera.

3. The neurosuit system of claim 1, wherein the sensory input device is an inertial measurement unit.

4. The neurosuit system of claim 1, wherein the suit control device is configured to:

obtain information associated with the ideal body movement from a memory; and compare the body movement with the information associated with the ideal body movement.

5. The neurosuit system of claim 1 further comprises a sensory output device configured to output feedback to the user.

6. The neurosuit system of claim 5, wherein the sensory output device comprises a vibrator.

7. The neurosuit system of claim 6, wherein the vibrator is movably attached to one or more bungee cords of the plurality of bungee cords or configured to be attached to a user's body part.

8. The neurosuit system of claim 6, wherein the predetermined action comprises actuating the vibrator.

9. The neurosuit system of claim 1, wherein the plurality of wearable pieces comprises one or more of a vest, shorts, knee pads, elbow pads, gloves, shoe attachments, and a hat.

10. The neurosuit system of claim 9, wherein the plurality of wearable pieces comprise at least the vest and the shorts, wherein each of the vest and the shorts comprises a plurality of vertical straps on a front portion and a back portion, and wherein each vertical strap comprises a plurality of hooks configured to engage with the bungee cords.

11. The neurosuit system of claim 10, wherein the plurality of hooks comprises a horizontal set of hooks and a vertical set of hooks, and wherein the horizontal set of hooks are oriented perpendicular to the vertical set of hooks.

12. The neurosuit system of claim 9, wherein the plurality of wearable pieces comprise at least the knee pads and the elbow pads, wherein each of the knee pads and the elbow pads comprises an opening at a center portion, and wherein the opening is covered by a fabric.

13. The neurosuit system of claim 12, wherein the neurosuit further comprises infrared light sources.

14. The neurosuit system of claim 9, wherein the plurality of wearable pieces comprise at least the vest and the shorts, and wherein the vest and the shorts are connected via a buckle connector.

15. A method comprising:

receiving, by a processor, inputs from a sensory input device of a neurosuit system, wherein the neurosuit system comprises a neurosuit and the sensory input device, wherein the neurosuit comprises:

a plurality of wearable pieces, and a plurality of bungee cords to interlock the plurality of wearable pieces, wherein the sensory input device is configured to capture a body movement of a user wearing the neurosuit;

determining, by the processor, the body movement based on the inputs;

comparing, by the processor, the body movement with an ideal body movement;

identifying, by the processor, a deficit in the body movement and the ideal body movement based on the comparison;

determining, by the processor, a muscle group associated with the deficit;

determining, by the processor, a bungee cord, of the plurality of bungee cords, associated with the muscle group; and, determining, by the processor, an optimal position of the bungee cord based on the deficit and the muscle group;

determining, by the processor, an existing position of the bungee cord;

comparing, by the processor, the existing position with the optimal position; and performing, by the processor, a predetermined action when the when the existing position is different from the optimal position, wherein the predetermined action is associated with the plurality of bungee cords, and wherein performing the predetermined action comprises:

generating a recommendation to change a position of the bungee cord from the existing position to the optimal position; and outputting the recommendation to a user interface.

16. A non-transitory computer-readable storage medium having instructions stored thereupon which, when executed by a processor, cause the processor to:

receive inputs from a sensory input device of a neurosuit system, wherein the neurosuit system comprises a neurosuit and the sensory input device, wherein the neurosuit comprises:

a plurality of wearable pieces, and a plurality of bungee cords to interlock the plurality of wearable pieces, wherein the sensory input device is configured to capture a body movement of a user wearing the neurosuit;

determine the body movement based on the inputs;

compare the body movement with an ideal body movement;

identify a deficit in the body movement and the ideal body movement based on the comparison;

determine a muscle group associated with the deficit;

determine a bungee cord, of the plurality of bungee cords, associated with the muscle group; and, determine an optimal position of the bungee cord based on the deficit and the muscle group;

determine an existing position of the bungee cord;

compare the existing position with the optimal position; and perform a predetermined action when the when the existing position is different from the optimal position, wherein the predetermined action is associated with the plurality of bungee cords, and wherein, to perform the predetermined action, the processor:

generates a recommendation to change a position of the bungee cord from the existing position to the optimal position; and outputs the recommendation to a user interface.

* * * * *